US010428574B2

(12) United States Patent
Fallaolita

(10) Patent No.: US 10,428,574 B2
(45) Date of Patent: Oct. 1, 2019

(54) DOOR OPENABLE IN CASE OF STRUCTURAL FAILURE

(71) Applicant: Luca Fallaolita, Avezzano (IT)

(72) Inventor: Luca Fallaolita, Avezzano (IT)

( * ) Notice: Subject to any disclaimer, the term of this patent is extended or adjusted under 35 U.S.C. 154(b) by 0 days.

(21) Appl. No.: 15/123,245

(22) PCT Filed: Mar. 5, 2015

(86) PCT No.: PCT/IB2015/051627
§ 371 (c)(1),
(2) Date: Sep. 1, 2016

(87) PCT Pub. No.: WO2015/132758
PCT Pub. Date: Sep. 11, 2015

(65) Prior Publication Data

US 2017/0074033 A1 Mar. 16, 2017

(30) Foreign Application Priority Data

Mar. 6, 2014 (IT) ..... AQ2014A0001

(51) Int. Cl.
*E06B 5/10* (2006.01)
*E05B 65/10* (2006.01)
(Continued)

(52) U.S. Cl.
CPC ..... *E06B 5/10* (2013.01); *E05B 63/0065* (2013.01); *E05B 63/18* (2013.01); *E05B 65/10* (2013.01);
(Continued)

(58) Field of Classification Search
CPC ..... E06B 5/10; E06B 5/00; E05B 63/0069; E05B 65/10; E05B 2063/0095
See application file for complete search history.

(56) References Cited

U.S. PATENT DOCUMENTS 3,364,298 A * 1/1968 Peters ..... H05K 9/0015 174/351
4,429,495 A * 2/1984 Aoki ..... E05B 15/0225 292/341.11
(Continued)

FOREIGN PATENT DOCUMENTS

CL 02317-2007 12/2009
CN 101349136 A 1/2009
(Continued)

OTHER PUBLICATIONS

English Abstract of JP H09189174 A dated Jul. 22, 1997.
(Continued)

*Primary Examiner* — Marcus Menezes
(74) *Attorney, Agent, or Firm* — Hedman & Costigan, P.C.; James V. Costigan; Kathleen A. Costigan

(57) ABSTRACT

A door openable in case of structural failure has a front face (2) and a rear face (3), vertical hinge and lock sides (4, 5) with a lock latch (6). The door has a major door portion (8) bearing a lock, and at least one end door portion (9, 30), both being enclosed by said front and rear faces (2, 3), vertical hinge and lock sides (4, 5) and a surface (10) inclined downwardly from the front face (2) to the rear face (3). A plurality of energy absorbers are arranged in correspondence of said inclined surface (10) in order to permit an offset of the end door portions (9, 30) with respect to the major door portion (8). A releasing rod (23) for unlocking the lock latch (6) moves upwards under the action of the springs (27), due to said offset, returns the lock latch (6) into the door lock and retains it in unlocked position.

7 Claims, 6 Drawing Sheets

(51) Int. Cl.

| | |
|---|---|
| ***E06B 5/00*** | (2006.01) |
| ***E05B 63/00*** | (2006.01) |
| ***E05B 63/18*** | (2006.01) |

(52) U.S. Cl.
CPC ..... *E06B 5/00* (2013.01); *E05B 2063/0095* (2013.01)

(56) References Cited

U.S. PATENT DOCUMENTS

| | | | | |
|---|---|---|---|---|
| 4,726,161 | A * | 2/1988 | Yaghoubian | E04H 9/023 248/585 |
| 5,850,710 | A * | 12/1998 | Brock | E05B 65/1046 49/141 |
| 5,927,019 | A * | 7/1999 | Ichida | E06B 5/00 49/501 |
| 6,745,515 | B1 * | 6/2004 | Chen | E05B 65/10 160/180 |
| 2008/0034818 | A1 | 2/2008 | Di Vinadio | |
| 2015/0330138 | A1 * | 11/2015 | Staton | F16F 1/04 52/173.1 |
| 2017/0130515 | A1 * | 5/2017 | Pardue | E06B 3/301 |

FOREIGN PATENT DOCUMENTS

| | | | |
|---|---|---|---|
| JP | H08210046 | A | 8/1996 |
| JP | H094337 | A | 1/1997 |
| JP | H0925746 | A | 1/1997 |
| JP | H09189174 | A | 7/1997 |
| JP | H09256694 | A | 9/1997 |
| JP | 2002-121977 | A | 4/2002 |
| WO | 2012/052576 | A1 | 4/2012 |

OTHER PUBLICATIONS

English Abstract of JP H0925746 A dated Jan. 28, 1997.
English Abstract of JP H08210046 A dated Aug. 13, 1996.
English Abstract of JP 2002-121977 A dated Apr. 26, 2002.
English Abstract of JP H094337 A dated Jan. 7, 1997.
English Abstract of JP H09256694 A dated Sep. 30, 1997.
Official Action from Chilean Patent Office in corresponding application Serial No. 201602230 dated Jun. 29, 2018. (Spanish).
English translation of Official Action from Chilean Patent Office in Serial No. 201602230 dated Jun. 29, 2018.
Official Action from Columbian Patent Office in corresponding application Serial No. NC2016/0002763 (Spanish).
English Abstract for CN 101349136 A dated Jan. 21, 2009.
English Abstract for JP H08210046 A dated Aug. 13, 1996.

* cited by examiner

DOOR OPENABLE IN CASE OF STRUCTURAL FAILURE

TECHNICAL FIELD

The present invention relates to a door openable in case of structural failure. Normally, disasters such as earthquakes, fires, floods, cause structural failures in buildings with resulting deformation even on windows and doors, especially on the door frames and wings. It is not uncommon, for example, that following a seismic event a collapse of parts of a building or a lifting of floor block a door wing that hinders the exit. The invention is aimed, therefore, to the doors in general but also to their locks that can be blocked as a result of a structural failure.

BACKGROUND ART

JP H09 25746 A describes a lock contained within a box that can be retracted automatically within a traditional door wing, thanks to the action of springs. An adjustment member maintains the lock box in an extended position. In case of a seismic event, an interlocking mechanism acts on the adjustment member in such a way that the lock box is automatically released and retracted into the door by the springs. In this way the lock latch is disengaged from the door frame, and the door is free to be opened. The interlocking mechanism is actuated by sensors applied above and below the door.

JP H09 256694 A describes a lock placed inside a box similar to that in the previous document, with different adjustment member and interlocking mechanism.

Furthermore JP H09 4337A has sensors between the door frame and the door wing, the sensors being configured to operate a latch of a lock without any displacement of the box that contains the lock.

The documents cited above describe lock unlocking devices that employ sensors. It may happen that the sensors do not work properly because they simply detect small point deformations limited to the border area between the door frame and the door wing. Moreover, they do not take into account the deformation of the door itself that per se hinders the door.

DISCLOSURE OF THE INVENTION

The present invention aims to overcome the above mentioned drawbacks.

The main purpose of the present invention is to provide a door openable in case of structural failure.

Another object of the present invention is to provide a lock unlocking device for releasing the lock of a door of a building which has suffered a structural failure.

To achieve the purpose mentioned above, the present invention, as defined in claim 1 attached to this description, provides a door openable in case of structural failure, the door having a larger portion and at least one end portion, both enclosed by the vertical sides of the door and by a surface inclined downwardly from the front face to the rear face of the door, on said inclined surface lying a plurality of energy absorbers.

Such a structural arrangement allows a device to be applied to the door for releasing the lock latch driven by the shift of the end portion on the lower portion along the inclined surface.

BRIEF DESCRIPTION OF DRAWINGS

Further features and advantages of the invention will become more apparent from the description of embodiments of the door openable in case of structural failure, illustrated by way of an indicative and not limiting example in the accompanying drawings in which.

DESCRIPTION OF A PREFERRED EMBODIMENT OF THE INVENTION

Figure 1:
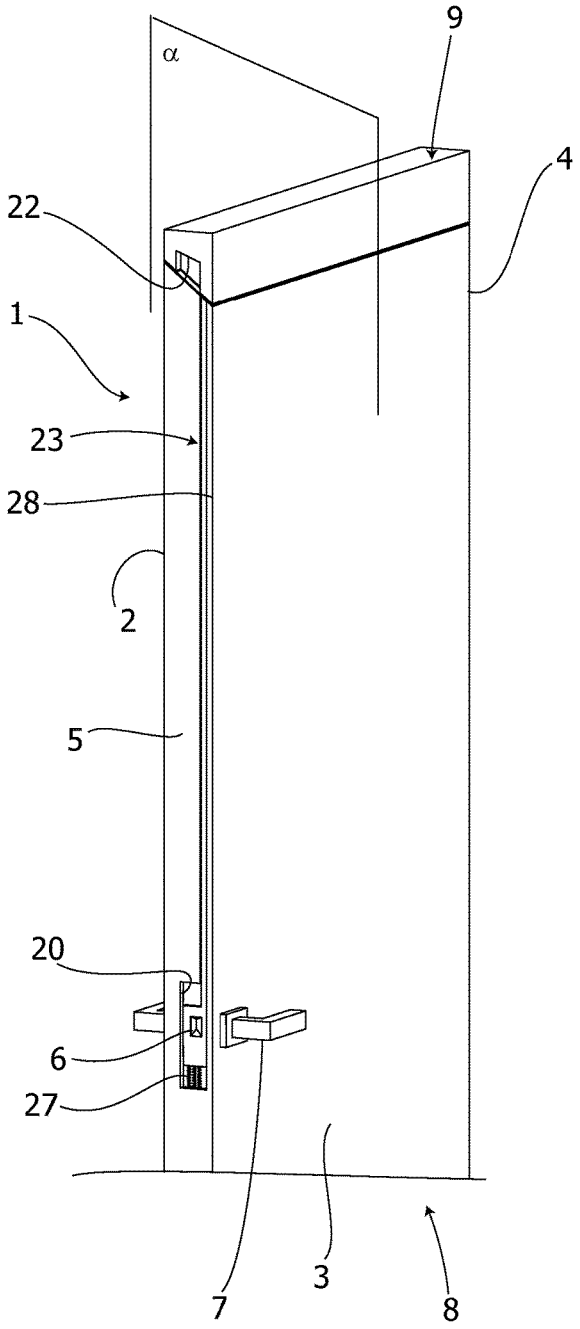
FIG. 1 is a partial perspective view of a door according to the present invention when not subjected to particular stresses.
Figure 2:
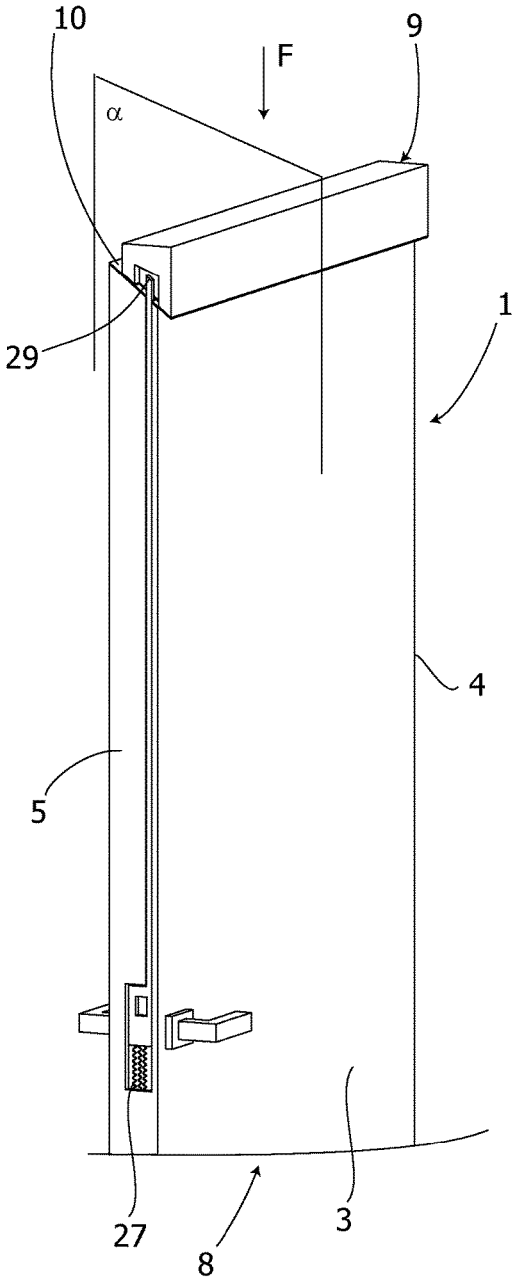
FIG. 2 is a partial perspective view of the door in FIG. 1 when subjected to a significant load from the top downwards.

First, reference is made to FIGS. 1 and 2, which show in partial perspective view a door 1 according to the present invention not subjected to particular stress and, respectively, the same port 1 subjected to a significant load, which is indicated as F, from the top downwards. The load F could be transmitted to the door frame and then to the door itself, due to the failure of an overlying masonry.

Figure 3:
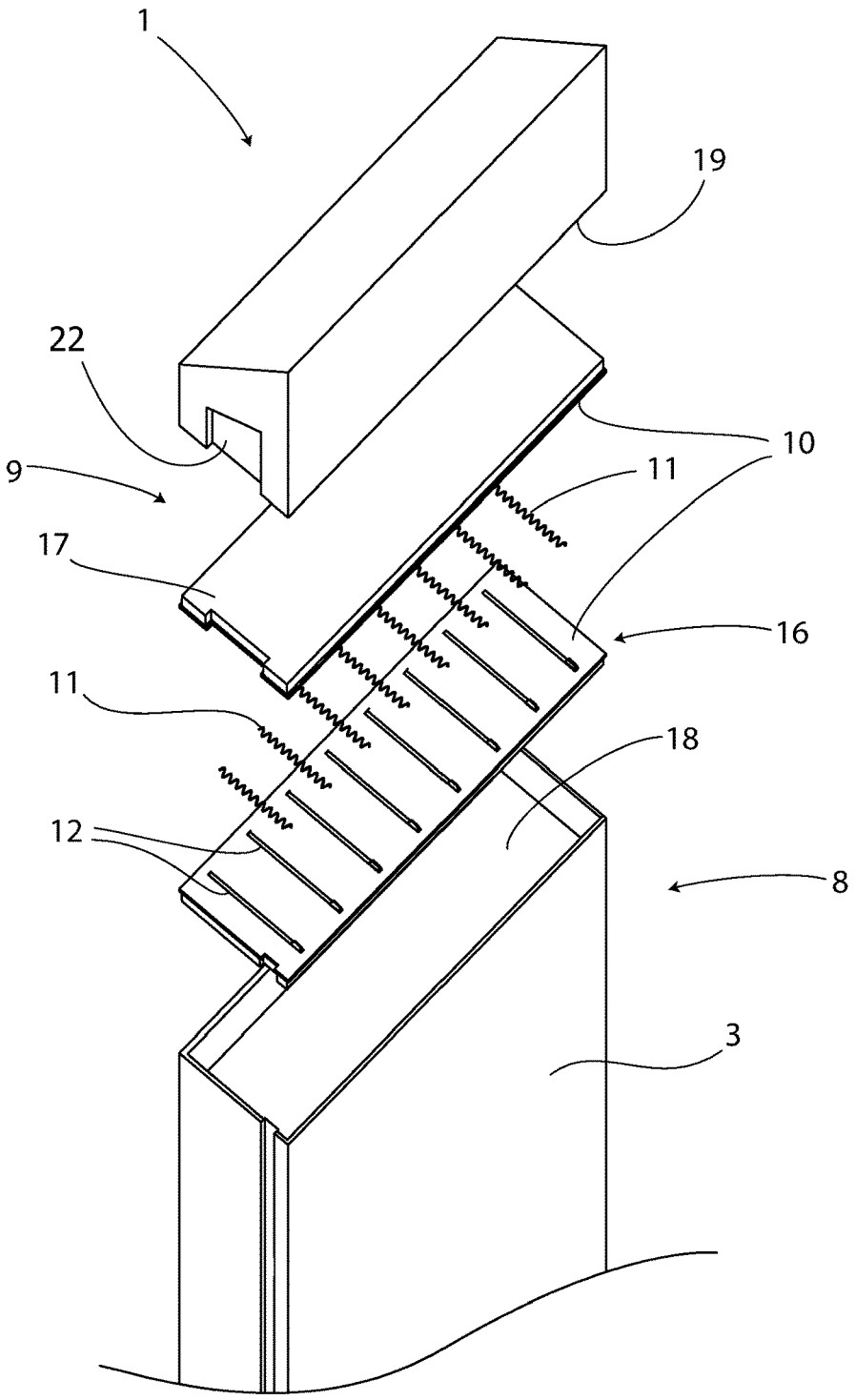
FIG. 3 is an exploded perspective view of an upper part of the door in FIG. 1.

Traditionally, the door openable in case of structural failure according to the invention has a front face 2, for example facing out, and a rear face 3 facing inside. Further, the door 1 has a vertical hinge side 4 and an opposite vertical lock side 5, projected from which is a lock latch 6 operated by handles 7 for closing the door. According to the invention, the door 1 comprises a major door portion 8 bearing the handles 7, and an upper end door portion 9. Normally, the major door portion 8 and the upper end door portion 9 have such a configuration to constitute together a normal door, and are both bounded by vertical door sides 4, 5 and by a surface 10 inclined downwards from the front face 2 to the rear face 3 of the door. A plurality of energy absorbers lie along the surface 10, as shown only in part in FIG. 2, but better represented in the exploded perspective view in FIG. 3.

The energy absorbers are torsion coil springs 11 operating at compression that are housed in respective semi-cylindrical elongated seats 12, 13 formed correspondingly in the major portion 8 (visible in FIG. 3) and in the upper end door portion 9 on their sides delimited by the inclined surface 10.

Figure 4:
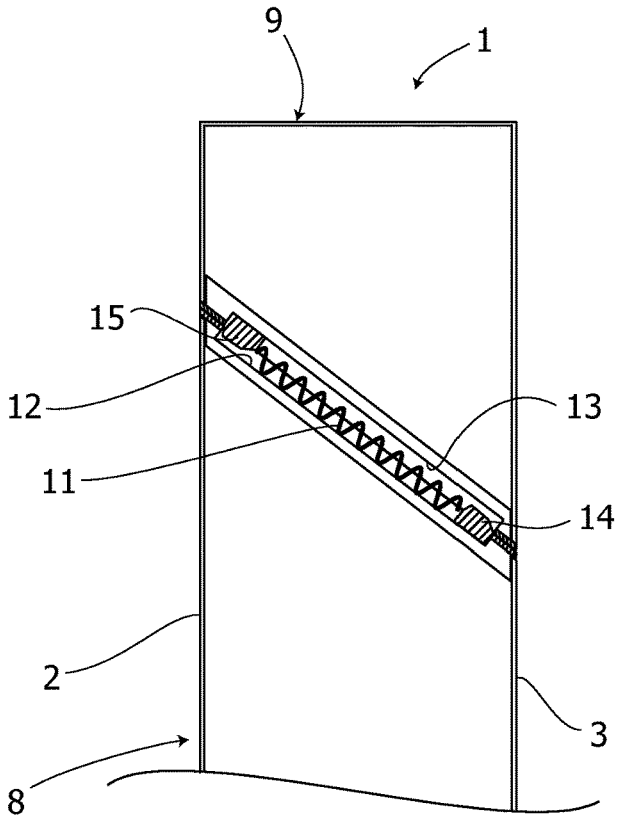
FIG. 4 is a partial cross-section view of the door in FIG. 1 taken along an orthogonal plane $\alpha$.
Figure 5:
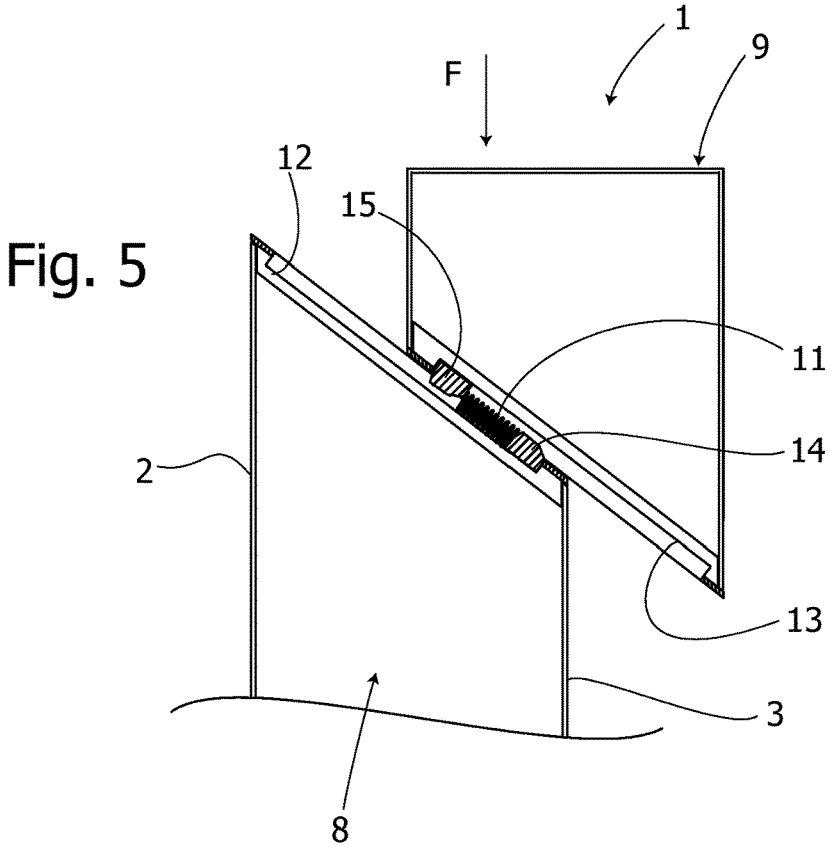
FIG. 5 is a partial perspective view of the door of FIG. 2 taken along an orthogonal plane $\alpha$.

The semi-cylindrical elongated seats 12, 13 are best shown in FIGS. 4 and 5, which are partial cross-section views of the door in FIGS. 1 and 2 as taken along an orthogonal plane $\alpha$. An abutment element 14, 15 for each coil spring 11 is integral with the major portion 8 and the upper end door portion 9, into the respective opposite ends of the semi-cylindrical elongated seats 12, 13.

Preferably, the semi-cylindrical elongated seats 12, 13 are made in panels 16, 17, that are inserted in the upper side 18 of the major door portion 8 and in the bottom side 19 of the upper end door portion 9.

Figure 6:
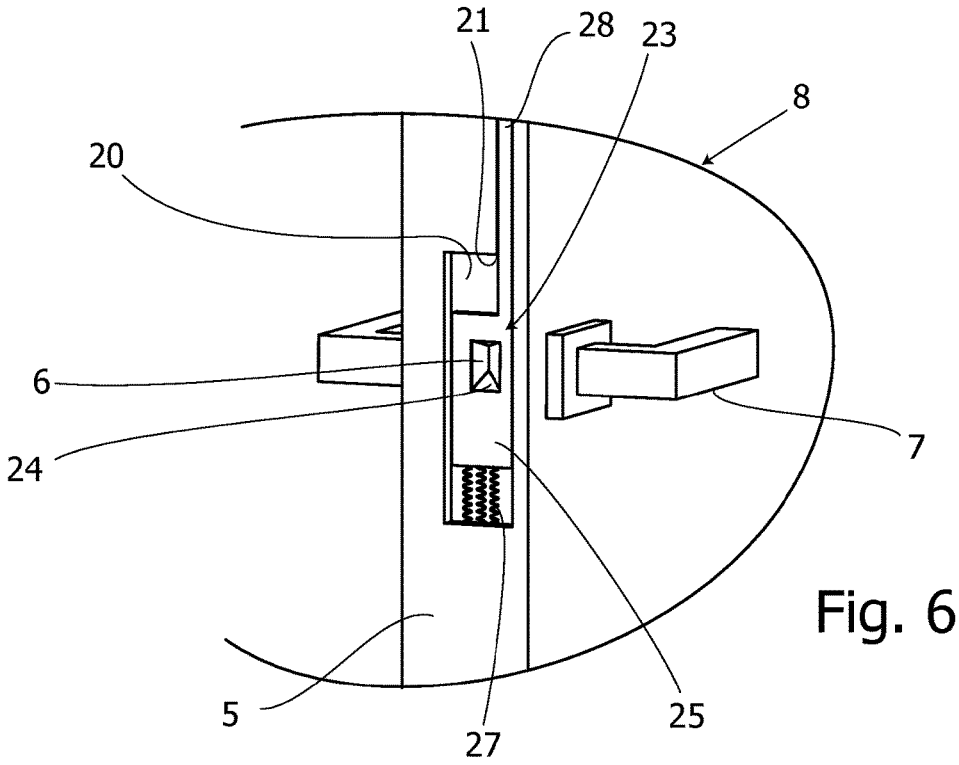
FIGS. 6 and 7 are enlarged partial perspective views that show the door lock according to the present invention in a closed position and in an unlocked position.
Figure 7:
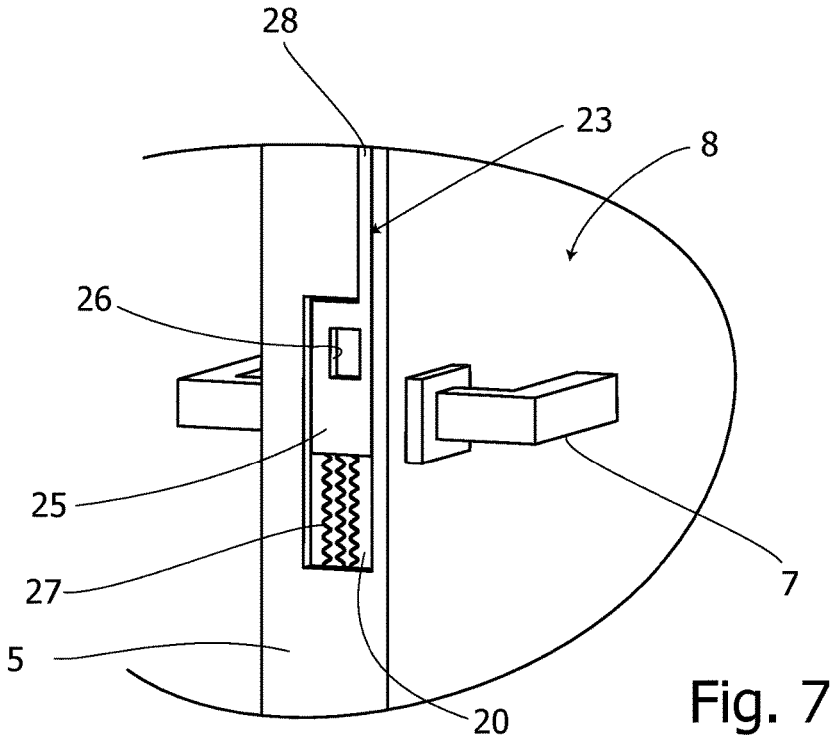

Referring now also to partial perspective views in FIGS. 6 and 7, which show the door lock according to the present invention in a closed position and in an unlocked position.

Formed in the vertical lock side 5 of the door 1 is a lowered surface 20 around the lock latch 6; the lowered surface 20 continues in a groove 21 extending upward throughout the major door portion 8. Formed in the upper end door portion 9 is a recess 22. Received in a lowered surface 20 and in the groove 21 of the major door portion 8 of the door 1 is a releasing rod 23 for unlocking the lock latch. The lock latch 6 is configured so that it has a downwardly tapered plan 24.

The releasing rod 23 for unlocking the lock latch has a portion 25 with a bore 26 adapted to receive the lock latch 6 in a through manner. The portion 25 is loaded by springs 27 upwards in the lowered surface 20. The releasing rod 23 has also a stem 28 received in the groove 21 and terminates at the top with a tip 29 designed to abut against the upper end door portion 9 when the front face 2 and the rear face 3 of the major door portion 8 and the upper end door portion 9 are coplanar. This happens when the load F is not applied on the door.

When the front face 2 and the rear face 3 of the upper end door portion 9 are subjected to offset inwardly with respect to the same front and rear faces of the major portion 8 following the application of a load F from top to bottom on the door 1, the tip 29 of the releasing rod 23 enters the recess 22 of the upper end door portion 9. When the latch releasing rod 23 moves upwards under the action of the springs 27 acting on it, as a result of the offset of the upper end door portion 9 with respect to the major door portion 8, it passes over the lock latch 6 with a result of inserting the lock latch 6 within the door and holding it in the unlocked position.

Figure 8:
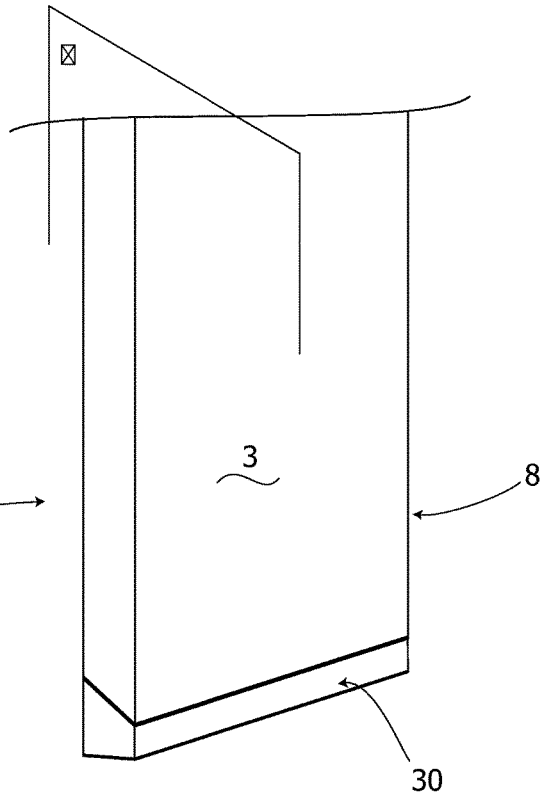
FIG. 8 is a partial perspective view of the lower portion of a door according to the present invention.

Reference is made now to FIGS. 8 to 11 which are, respectively, a partial perspective view of the lower end door portion of a door according to the present invention, a partial perspective view in exploded view and partial cross-section views of the portion of the door of FIG. 8 taken along a plane orthogonal β position, respectively without and with a thrust from the bottom upwards.

Figure 9:
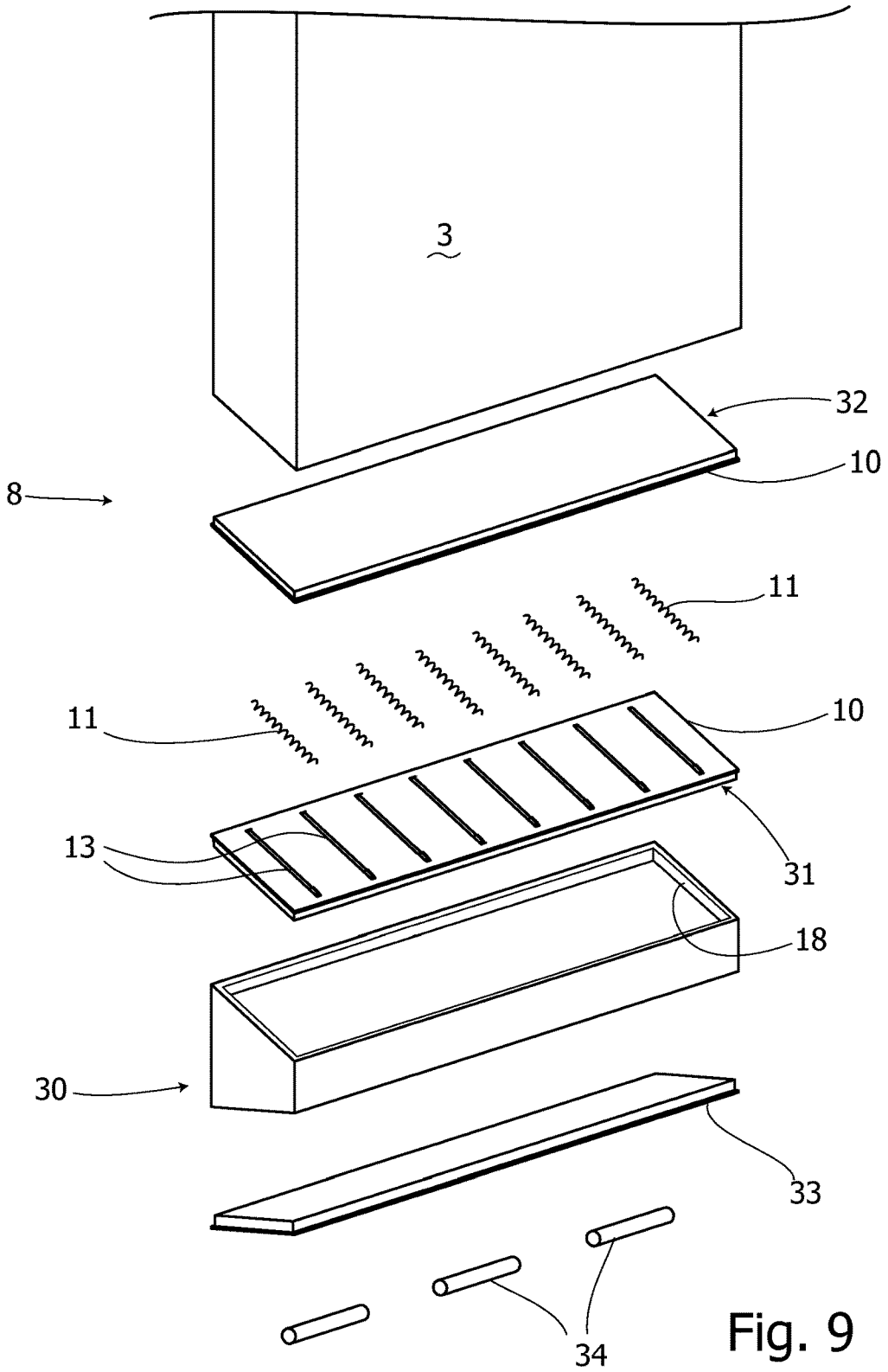
FIG. 9 is a partial exploded perspective view of the lower portion of the door in FIG. 8.

As shown, in particular in FIG. 9, the door 1, either with the upper end door portion 9 or in the absence of it, has a lower end door portion 30 connected to the major door portion 8. Similarly to what is described above with reference to FIG. 3, and using the same reference numerals for denoting identical or similar parts, the major door portion 8 and the lower end door portion 30 are configured in order to form together a normal door, and both are enclosed by the vertical door sides 4, 5 and by a surface 10 inclined downwardly from the front face 2 to the rear face 3 of the door 1. Along the surface 10, shown only in part in FIG. 1 but better represented in the exploded perspective view in FIG. 9, a plurality of energy absorbers lie in the form of torsion coil springs 11 working in compression. The torsion coil springs 11 are housed in respective semi-cylindrical elongated seats 12, 13 formed correspondingly in the major door portion 8 and the lower end door portion 30 (visible in FIG. 9) on their sides delimited by the inclined surface 10.

Figure 10:
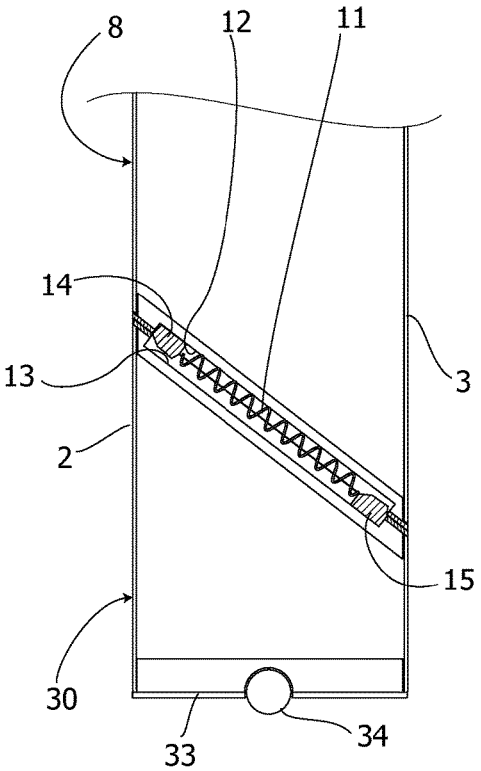
FIGS. 10 and 11 are partial cross-section view of the portion of the door in FIG. 8 taken along an orthogonal plane $\beta$ in a position without and with a thrust from the bottom upwards, respectively.
Figure 11:
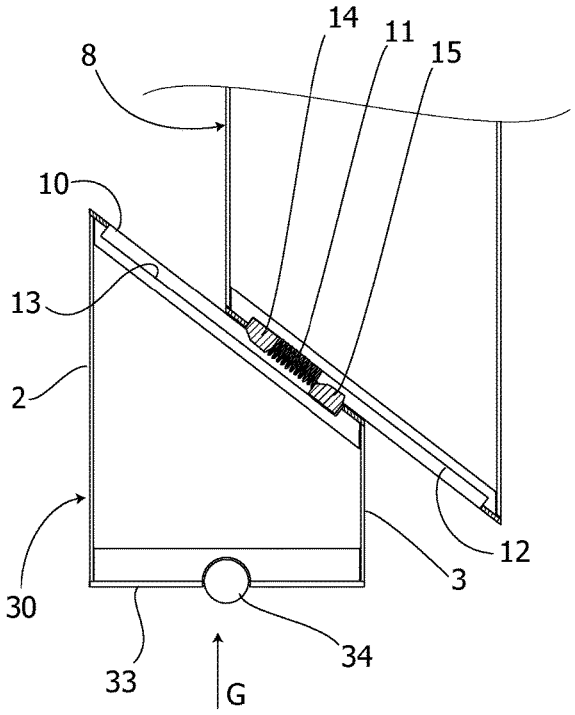

The semi-cylindrical elongated seats 12, 13 are best shown in FIGS. 10 and 11. An abutment element 14, 15 for each torsion coil spring 11 is integral with the major door portion 8 and the lower end door portion 9, into the respective opposite ends of the semicylindrical elongated seats 12, 13.

As described above, the semi-cylindrical elongated seats 12, 13 are preferably made of panels 31, 32 that are inserted in the upper side 18 of the lower end door portion 30 and in the bottom side of the major door portion 8.

Advantageously, the lower end door portion 30 has a bottom panel 33 inserted in which are rolling friction elements 34 in the form of rollers.

When the door, which is hinged traditionally, although not shown in the drawings, receives a thrust from the bottom to top indicated by the arrow G, as a result, for example, of the lifting of the floor (not shown), the lower end door portion 30 of the door 1 moves upward by sliding. This sliding is facilitated by the rolling friction elements 34 in contact with the floor.

The operation of the door according to the present invention should be clear. When deformations occur to the door contour, for example on its frame, which would lead to a compression of the door substantially from below and above, the door would remain stuck in the position in which it is. This is particularly dangerous when the door is in the closed position because the exit would be blocked, in case of the structural failure, for example following a seismic event. The deformation of the door due to the displacement of its portions along the inclined surface 10 reduces the size thereof, thus allowing the rotation of the door on its hinges. If the door is in the closed position and the load is applied from above, the latch releasing device would still enable the opening of the door.

It should be evident that the release device may be connected with the lower end door portion, instead of the upper one. The sliding of the release would be down.

It is clear that, when the critical time is over and there is no more abnormal strain on the door, the energy absorbers will no longer be in their compressed position and the door will be able to resume its normal configuration.

The invention claimed is:

1. A door openable in case of structural failure, having a front face (2) and a rear face (3), a vertical hinge side (4) and a latch side (5) from which a latch (6) protrudes for latching said door, characterized in that:

said door comprises a major door portion (8) bearing said latch (6) and at least one end door portion (9,30) where said at least one end door portion (9,30) is partially enclosed by a first portion of said front face (2) and said rear face (3);

where said major door portion (8) is enclosed by:

(a) a second portion of said front face (2) and said rear face (3);

(b) by said vertical hinge side (4); and (c) by said latch side (5) of said door;

wherein said door has a surface (10) inclined downwardly from said front face (2) to said rear face (3) that encloses said major door portion (8), said surface (10) being between said major door portion (8) and said at least one end door portion (9,30), wherein a plurality of energy absorbers are arranged so that said energy absorbers lie along said inclined surface (10), wherein said plurality of energy absorbers are torsion coil springs (11) working in compression, which are housed in respective semi-cylindrical elongated seats (12, 13) formed correspondingly in said major door portion (8) and in said at least one end door portion (9,30), said torsion spring coils (11) being arranged on said inclined surface (10) where an abutment element (14, 15) is provided for each torsion coil spring (11), said abutment element (14,15) being integral with said major door portion (8) and said at least one end door portion (9,30) being positioned at opposite ends of said semi-cylindrical elongated seats (12, 13).

2. The door according to claim 1, wherein said at least one end door portion is an upper end door portion (9) and a lower end door portion (30).

3. The door according to claim 2, wherein a lowered surface (20) is formed on the latch side (5) of the door around said latch (6), said lowered surface (20) being continued as a groove (21) that extends upwardly through said major door portion (8) and a recess (22) in said upper end door portion (9), so that said groove (21) is adapted to receive a releasing rod (23) for unlatching the latch (6).

4. The door according to claim 3, wherein said releasing rod (23) for unlatching the latch (6) has:

a portion (25) provided with a bore (26) adapted to receive in a through manner said latch (6) loaded by springs (27) upwardly in said lowered surface (20);

a stem (28) received in said groove (21) that terminates at a top of said groove with a tip (29);

said tip (29) being adapted to abut against said upper end door portion (9) when said second portion of said front face (2) and said rear face (3) that enclose said major door portion (8) and said first portion of said front face (2) and said rear face (3) that partially enclose said upper end door portion (9) are coplanar, and to enter said recess (22) of said upper end door portion (9) when said first portion of front face (2) and said rear face (3) that partially enclose said upper end door portion (9) are inwardly offset with respect to said second portion of said front face (2) and said rear face (3) that enclose said major door portion (8) due to a load (F) applied downwardly on said upper end door portion (9) so that said major door portion (8) and said upper end door portion (9) are not coplanar.

5. The door according to claim 4, wherein the latch (6) has a surface tapered towards a bottom of said door so that when the releasing rod (23) for unlatching the latch (6) is moved upwardly, in response to an action of springs (27) to inwardly offset said upper end door portion (9), said latch (6) is moved into said door where said latch (6) is retained in an unlatched position.

6. The door according to claim 2, wherein said lower end door portion (30) moves upwardly when said lower end door portion (30) receives an upward thrust as a result of a lifting of a floor below said lower end door portion.

7. The door according to claim 2, wherein said lower end door portion (30) has rolling friction lowering elements (34) that contact a floor.

* * * * *